US010796683B2

(12) United States Patent
Hutchinson et al.

(10) Patent No.: US 10,796,683 B2
(45) Date of Patent: Oct. 6, 2020

(54) ACTIVE NOISE CONTROL MICROPHONE ARRAY

(71) Applicant: Invictus Medical, Inc., San Antonio, TX (US)

(72) Inventors: George Martin Hutchinson, San Antonio, TX (US); Lilin Du, San Antonio, TX (US)

(73) Assignee: Invictus Medical, Inc., San Antonio, TX (US)

( * ) Notice: Subject to any disclaimer, the term of this patent is extended or adjusted under 35 U.S.C. 154(b) by 0 days.

(21) Appl. No.: 16/565,485

(22) Filed: Sep. 10, 2019

(65) Prior Publication Data

US 2020/0005758 A1 Jan. 2, 2020

Related U.S. Application Data

(63) Continuation of application No. 16/018,452, filed on Jun. 26, 2018, now Pat. No. 10,410,619.

(60) Provisional application No. 62/524,895, filed on Jun. 26, 2017.

(51) Int. Cl.
*G10K 11/178* (2006.01)
*H04R 1/08* (2006.01)
*H04R 3/00* (2006.01)

(52) U.S. Cl.
CPC ..... *G10K 11/178* (2013.01); *G10K 11/17881* (2018.01); *H04R 1/08* (2013.01); *G10K 2210/1082* (2013.01); *H04R 3/005* (2013.01)

(58) Field of Classification Search
None
See application file for complete search history.

(56) References Cited

U.S. PATENT DOCUMENTS 5,699,437 A * 12/1997 Finn ..... G10K 11/17857 381/71.7

* cited by examiner

*Primary Examiner* — Kenny H Truong
(74) *Attorney, Agent, or Firm* — Robert A. Lawler

(57) ABSTRACT

An apparatus and method are presented for an active noise control system with a selector mechanism to select an appropriate reference signal for an active noise control algorithm responsive to several noise sources, some of which generate may sounds intermittently.

20 Claims, 7 Drawing Sheets

200Hz

500Hz 1,000Hz

ACTIVE NOISE CONTROL MICROPHONE ARRAY

CROSS-REFERENCE TO RELATED APPLICATIONS

This application is a continuation of and claims priority to U.S. Pat. No. 10,410,619, which claims priority to U.S. Provisional Application No. 62/524,895, filed Jun. 26, 2017, which are hereby incorporated by reference in their entirety.

BACKGROUND OF THE INVENTION

1. Field of the Invention

The present invention relates generally to active noise control systems and methods.

2. Description of Related Art

Technological advances in neonatal intensive care have contributed greatly to decreases in infant mortality. The neonatal intensive care unit (NICU) clinical team must provide support of basic functions including temperature and humidity control, nutritional support, fluid and electrolyte maintenance, respiratory support, and skin integrity management. However, the mission of NICU care is also to support the healthy development of the infant. A critical component of healthy development is limiting the noxious noise to which the patient is exposed while providing appropriate aural stimulation to promote brain and language development. Today, there is no effective solution available for these two facets of developmental care. In the same way that technology has been brought to bear on the physiologic needs through incubators for temperature and humidity management or ventilators for respiratory support, it can also be applied to address these developmental concerns.

Noise levels in NICUs have been shown to be consistently louder than guidelines provided by the American Academy of Pediatrics (AAP). These guidelines stipulate that the noise levels that the hospitalized infants are exposed to should not exceed 45 dB, A-weighted (dBA), averaged over one hour and should not exceed a maximal level of 65 dBA averaged over one second. Noise measured both inside and outside an incubator show guidelines are frequently exceeded throughout the day.

Looking specifically at the sources of noise in the NICU, most are life-critical devices or communication between caregivers, which is often essential for proper care of patients. Specifically, the continuous positive airway pressure (CPAP) device and bradycardia alarms have been reported as between 54 and 89 dBA. Other noise sources include incubator alarms, IV pump alarms, general conversation, telephones, intercom bells, high frequency oscillatory ventilators, televisions, and trolleys or cars. Many of these are essential elements of safe NICU care; their use is not optional, yet they provide a noise hazard to the patient population.

Health risks from noise exposure are many and significant. One growing concern is the indication that NICU noise negatively impacts intellectual development. Hearing loss may be another long-term sequela of NICU noise. It is intuitive that increased noise levels will interfere with the sleep of an infant and this correlation is demonstrated in numerous studies. Adequate sleep is essential for normal development and growth of preterm and very low birth weight infants and can enhance long-term developmental outcomes. Similarly, it has been shown that noise increases various measures of stress in hospitalized infants. Stress is quantified through many surrogates including vital signs, skin conductance, and brow furrowing. While excessive noise is shown to be detrimental to the well-being of the hospitalized infant, proper exposure to human voices, especially in directed communication between parents and the infant, is proving to be beneficial. A correlation exists between the amount of adult language the preterm infant is exposed to in the NICU and the quantity of reciprocal vocalizations and meaningful early conversations.

Active noise control (ANC) may comprise sampling an original varying sound pressure waveform in real time, analyzing the characteristics of the sound pressure waveform, generating an anti-noise waveform that is essentially out of phase with the original sound pressure waveform, and projecting the anti-noise waveform such that interferes with the original sound pressure waveform. In this manner, the energy content of the original sound pressure waveform is attenuated.

Early implementations of this technique were realized with analog computers as early as the 1950s. However, these analog implementations were not able to adapt to changing characteristics of the noise as the environmental conditions changed. With digital technology, adaptive ANC became possible. Sound waves are described by variations in acoustic pressure through space and time where acoustic pressure is the local deviation from atmospheric pressure caused by the sound wave. Incident sound waves can superimpose one upon another in which the net response at a given position and time is the algebraic sum of the waveforms at that point and time. This is known as constructive interference if the resulting pressure is greater than the pressure of any of the incident waveforms and destructive interference if the resulting pressure is less than any of the incident waveforms.

Active noise control can be implemented with a feedforward system employing an upstream microphone that characterizes a sound wave propagating towards a zone. The characterized sound wave acts as a reference signal to an electronic control system that generates a sound wave called a control signal that is essentially 180 degrees out of phase with the reference signal. The control signal is propagated towards the zone and in that zone, the control signal and reference signal interfere with each other. An error microphone is oriented in the zone and measures the sound wave resulting from the interference. This error signal is provided to the electronic control system such that the nature of the control signal can be altered to better reflect the exact opposite of the reference signal. This process continues until the electronic control system converges on an optimum solution to minimize the amplitude of the sound wave in the zone. In this manner, the system is said to be adaptive since the error microphone continuously provides a new signal to the electronic control system as environmental conditions change with the resulting change in the sound wave that propagates towards the zone.

Alternately, active noise control systems can employ a feedback technique. In this approach, a control signal is propagated towards a zone and an error microphone oriented in the zone measures the error signal, which is the response of the sound wave resulting from the interference of the control signal and ambient sound waves that are coincidentally in the zone. The error signal is processed to derive a suitable reference signal to generate a control signal that would better reflect the exact opposite of the coincident sound waves in the zone. This is repeated until the control system converges on an optimum solution to minimize the amplitude of the sound wave in the zone. This system is also adaptive in the same manner as the feedforward system. The feedforward and feedback approaches can be combined into a hybrid feedforward/feedback control system.

Active noise control techniques have been described for use in air ducts to attenuate the emitted sound pressure levels. Applications of duct noise control include: reduction of noise in air conditioning ducts; direction of noise in industrial blower systems; and reduction in vehicular exhaust noise. These can comprise a reference microphone placed upstream in the duct with the control signal being injected downstream to cancel the noise with a feedforward approach. These can also comprise an error microphone placed in the duct essentially at the point of a control source that propagates the control signal into the duct in a feedback approach.

Active noise control techniques have been described in other enclosed space applications. Active headsets have been described and constructed using either feedback or feedforward systems to minimize noise within ear cups of the headset. The small volume of the ear cup facilitates the noise reduction task. The error microphone and control signal source can be placed very close to the ear which improves performance by making the modeling more accurate. Infant incubators have also been described with ANC systems to minimize the noise within the enclosed space of the incubator. The reference microphone is place exterior to the incubator and the control source and error microphone is place within the interior the incubator.

In other applications, ANC systems have been described in other enclosed space situations in which the noise sources are known and predictable and the error microphone can be placed proximate an ear of a user. For instance, a system is described for automobile interiors in which tire sounds are sampled and coupled to a control unit that provides a control signal through a headrest speaker of a car seat. An error microphone within the headrest provides the error signal for the control unit to adapt the control signal. This has the advantage of a physical boundary between the noise source (tires on pavement) and the user's ears on the interior of the automobile. It also has the advantage of a fixed location of the noise source since the tires are permanently fixed to the four corners of the frame of the automobile. Finally, this system can provide for a wired connection between the reference microphone and the control unit, minimizing the transit time between the noise source and the control source.

Applications exist that have been said to be inappropriate for the ANC method. These include reduction of noise within an aircraft cabin or building space and reduction of noise in a space that contains many noise sources that may not be located in predictable positions.

BRIEF SUMMARY OF THE INVENTION

It is a fundamental objective of the present invention to minimize and overcome the obstacles and challenges of the prior art. In the following description, numerous details are set forth to provide a more thorough explanation of embodiments of the present invention. It will be apparent, however, to one skilled in the art, that embodiments of the present invention may be practiced without these specific details. As used herein, unless otherwise indicated, "or" does not require mutual exclusivity.

An active noise control system is provided for use proximate a support surface in an environment with multiple noise sources that to emit noise sound waves either on a constant, periodic, or irregular basis. The active noise control system comprises an array of reference input sensors is arranged essentially around the perimeter of the support surface, an error input sensor is adapted to be located proximate a spatial zone in which noise attenuation is desired, a control output transducer, and a control unit executing an adaptive algorithm. The control unit is in data communication with the array of reference input sensors, the error input sensor, and the control output transducer. The spatial zone is within the bounds of the support surface. The adaptive algorithm is configured to utilize input signals from the array of reference input sensors and the error input sensor to generate a control signal for the control output transducer. The control signal, when broadcast by the control output transducer, generates a control sound wave that is configured to destructively interfere with noise sound waves from the noise source or sources when the noise sound waves enter the spatial zone.

In the active noise control system, the reference input sensor is ideally placed between the spatial zone and the noise source. However, in use, it is not always possible to anticipate the location of the noise source relative to the spatial zone. Further, the position of noise source may change over time. In use, the environment may contain multiple noise sources, each of which may emit a noise sound wave at different times. This results in a noise sound wave coming at the support surface from one direction at one time and from another direction at another time. Alternately, a new noise source may be introduced into the environment around the support surface resulting in noise sound waves coming from a new direction based on the location of the new noise source. By way of an illustrative example, in a patient care area, a support surface may have a physiologic monitor positioned on one side and an infusion pump positioned on an opposite side. From time to time, an alarm signal may originate with the physiologic monitor while at another time an alarm signal may originate from the opposite side of the support surface from the infusion pump. At a later time, a ventilation support unit may be introduced by a third side of the support surface, the ventilator support unit emitting alarm sounds from time to time.

The active noise control system further comprises a selector mechanism, the selector mechanism adapted to select one or more input reference sensors of the array of input reference sensors at any given time to provide the reference input signal for the control unit's generation of the control signal. In one embodiment, the selector mechanism is adapted to consider the input signals from the array of reference microphones in the selection of the one or more of the array of input reference sensors. In another embodiment, the selector mechanism further comprises a directional sensor array that determines a vector of the noise source relative to the spatial zone and a selector in data communication with the reference input sensor array. The selector is adapted to direct one of the reference input signals from the array of reference input sensors to the control unit for use in the adaptive algorithm. In some embodiments, the active noise control system emphasizes the reference input signal from the reference input sensor closest to the noise source and deemphasizes the input of the other reference input sensors. In this manner, the sound waves from the closest noise source will pass by the selected reference input sensor before the sound waves impinge on the spatial zone. This provides additional time for the control unit and the active noise control algorithm to generate an appropriate destructively interfering control signal to be broadcast by the control signal output transducer towards the spatial zone.

These and other aspects of the devices of the invention are described in the figures, description, and claims that follow.

DETAILED DESCRIPTION OF THE INVENTION

Figure 1:
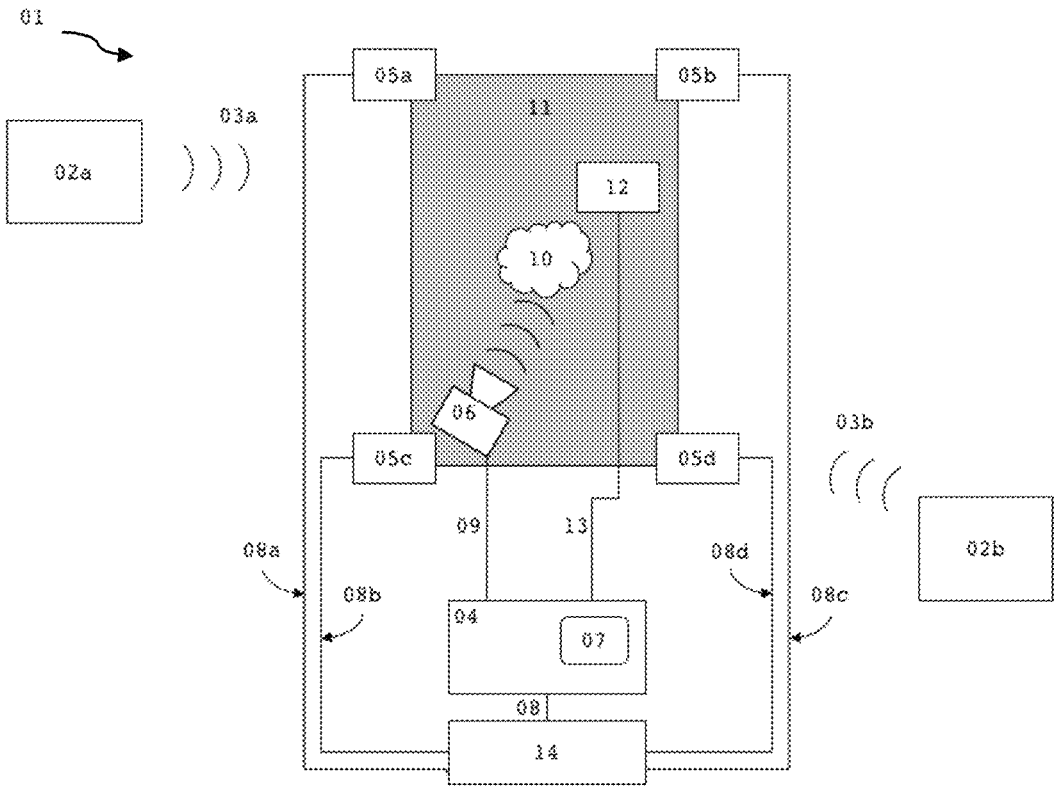
FIG. 1 shows an active noise control system with an array of reference input sensors that are configured to be responsive to more than one noise source from the environment.

Referring to FIG. 1, in one embodiment of the invention, an active noise control system (01) is provided for use in an area having a noise source (02*a*) that emits sound waves (03*a*). In some situations, a second noise source (02*b*) emitting a second set of sound waves (03*b*) is present. In other situations, the active noise control system (01) is deployed in an environment containing a plurality of noise sources, each emitting a separate set of sound waves. The active noise control system (01) comprises a control unit (04), a plurality of reference input sensors (05*a*, 05*b*, 05*c*, 05*d*), and a control signal output transducer (06). The plurality of reference input sensors (05*a*, 05*b*, 05*c*, 05*d*) and the control signal output transducer (06) are each in data communication with the control unit (04). The control unit may be a general-purpose microprocessor, a microcontroller, a digital signal processor, an application specific integrated circuit, a field programmable gate array, some combination of any of these, or the like. In a typical embodiment, the control unit (04) comprises a digital signal processor and a microcontroller. The control unit (04) is adapted to execute an active noise control algorithm (07) using a reference signal (08) selected from the plurality of reference input sensors (05*a*, 05*b*, 05*c*, 05*d*). The active noise control algorithm (07) generates a control signal (09) that is transmitted to the control signal output transducer (06) that transforms the control signal (09) to a physical movement of air. The active noise control algorithm (07) processes the reference signal (08) in a way to destructively interfere with any or all of the sound waves (03*a*, 03*b*) from the any or all of the originating noise source (02*a*, 02*b*) when these sound waves (03*a*, 03*b*) reach a spatial zone (10) of where noise attenuation is desired. The plurality of reference input sensors (05*a*, 05*b*, 05*c*, 05*d*) are often microphones adapted to respond to sound pressure levels in some embodiments although other sensor types are also appropriate. The control signal output transducer (06) is often a loudspeaker, also known as a speaker.

In use, the plurality of reference input sensors (05*a*, 05*b*, 05*c*, 05*d*) are oriented in an array proximate to a support surface (11), for instance, a surface as would be used to support a human occupant, for example a hospital patient. In typical embodiments, the support surface will be generally planar. In other embodiments, the support surface may be contoured to comfortably support an occupant. A spatial zone (10) is located within the perimeter of the support surface, defining a volume above the support surface (when viewed in three dimensions) where the head of the occupant will typically be located. The hospital patient may be an infant and the support surface (11) may be an incubator, crib, or bassinet. The hospital patient may be a pediatric patient or an adult patient and the support surface (11) may be a hospital bed. In some embodiments, the plurality of reference input sensors are located around the perimeter of the support surface (11) and approximately co-planar with the support surface (11). In embodiments where the support surface is part of a structure, such as a neonatal incubator, crib, or bassinet, the reference input sensors may be located around the perimeter of the support surface (11) either within the structure or on external surfaces of the structure, such as on an incubator wall. In other embodiments, the plurality of reference input sensors are located around the perimeter of the support surface (11) and above the plane of the support surface, below the plane of the support surface, or both.

The active noise control system (01) may further comprise an error input sensor (12) oriented proximate the spatial zone (10) and proximate the support surface (11). In some embodiments, the error input sensor is integral with the support surface. The error input sensor (12) is in data communication with the control unit (04), providing an error signal to the active noise control algorithm (07). The error input sensor (12) generates the error signal indicative of the amount of destructive interference of the control sound with the originating noise. The error signal is then presented to the active noise control algorithm (07) where the active noise control algorithm (07) refines the control signal (09) to minimize the resulting error signal. The error input sensor (12) is generally a microphone adapted to respond to sound pressure levels. In some embodiments, more than one microphone may be used. In other embodiments, other sensor types are also appropriate for use as an error correction sensor or sensors. For example, microphone pairs may be used in concert to determine sound particle velocity through a calculation of the difference between sound pressure levels of the microphone pair based on Bernoulli's principle. In some embodiments, multiple pairs of microphones organized in orthogonally arranged pairs may be used on concert to determine sound pressure velocities in multiple axes. In yet other embodiments, the sound pressure velocity or velocities are combined with measurements of sound pressure levels for a combined index of both potential and kinetic energy.

The active noise control system (01) further comprises a selector mechanism (14) in data communication with the control unit (04) and the plurality of reference input sensors (05*a*, 05*b*, 05*c*, 05*d*). In one embodiment, the selector mechanism (14) and control unit (04) may be formed in a single package or assembly, employing a digital signal processor and a microcontroller. In another embodiment, a field programmable gate array or application specific integrated circuit is included in a package with a digital signal processor. The invention provides for a variety of methods for the selector mechanism (14) to determine which of the reference input signals from the reference input sensors (05*a*, 05*b*, 05*c*, 05*d*) to provide as the input for the active noise control algorithm (07). In some embodiments, the control unit (04) is adapted to query a reference signal (08) from each of the reference input sensors (05*a*, 05*b*, 05*c*, 05*d*).

In use, any one of the noise sources (02*a*, 02*b*) in the environment of the active noise control system (01) is closer to one of the plurality of reference input sensors (05*a*, 05*b*, 05*c*, 05*d*) than it is to another of the plurality of reference input sensors. The control unit (04) is configured to use input from each of the plurality of reference input sensors (05*a*, 05*b*, 05*c*, 05*d*) to generate the control signal (09). In an embodiment, the control unit (04) is adapted to use an aggregate of the reference signals (08), each weighted equally, to generate a control signal (09) such that the output of loudspeaker (06) will effectively deconstructively interfere with the plurality of sound waves (03*a*, 03*b*) from the plurality of noise sources. In another embodiment, the reference signals (08) from the plurality of reference input sensors (05*a*, 05*b*, 05*c*, 05*d*) are individually weighted to provide a control signal (09) that optimally deconstructively interferes with the plurality of sound waves (03*a*, 03*b*) from the plurality of noise sources (02*a*, 02*b*). The weighting scheme in one example orders the relative magnitude of the weights according to the relative magnitude of the sound pressure levels of the sound waves. In some embodiments, the control unit (04) polls each of the plurality of reference input sensors (05*a*, 05*b*, 05*c*, 05*d*) in a cycle having a time duration, identifies the reference input sensor from the plurality of reference input sensors (05*a*, 05*b*, 05*c*, 05*d*) with the largest magnitude sound pressure level and uses that reference signal (08) in the active noise control algorithm (07). When the next polling cycle occurs, the plurality of input reference signals (08*a*, 08*b*, 08*c*, 08*d*) are rescanned to determine the current reference signal (08) with the greatest magnitude sound pressure level and that reference signal (08) is used for that cycle period. In an embodiment, the plurality of reference signals (08*a*, 08*b*, 08*c*, 08*d*) from the plurality of reference input sensors (05*a*, 05*b*, 05*c*, 05*d*) are analyzed for their frequency content to set the weights to be assigned for use by the active noise control algorithm (07). Some frequency spectra are more likely to be effectively deconstructively interfered than others. By way of an illustrative example, a reference signal (08) with higher proportion of periodic or sinusoidal information is more readily controlled by the active noise control system (01). As such, this reference signal (08) is weighted more than the reference signals (08*a*, 08*b*, 08*c*, 08*d*) from the rest of the plurality of reference input sensors (05*a*, 05*b*, 05*c*, 05*d*). By way of an illustrative example, the highest amplitude input reference signal (08) or signals queried would correspond to the reference input sensor or sensors closest to a noise source, and would therefore be the preferred reference input signal or signals for the adaptive algorithm. By way of another illustrative example, a high frequency signal above 5 kHz may be difficult to attenuate through deconstructive interference because of the processing speed needed to calculate and generate the canceling sound wave fast enough to meet the sound wave to be canceled without so much phase delay that attenuation is not achieved. As the speed of the signal processor decreases, the frequency of sound that can be attenuated drops. Also, because of the weight with which humans perceive sound frequencies, some sound frequencies are less important than others to attenuate. Nominally, humans perceive sound frequencies between about 1 kHz and 7 kHz with the same intensity. However, sounds of 100 Hz are perceived to be 20 dB less intense than sounds of 1 kHz. As such, the low frequencies of 100 Hz can be de-prioritized since they are already less perceptible by humans. The preferred reference input signals may be combined into a single reference input signal for the active noise control algorithm (07). These reference input signals may be appropriately weighted, for instance, based on their amplitude, frequency, or other characteristics. In an embodiment, the control unit is adapted to cycle through each of the array of reference input sensors at time intervals, selecting the preferred reference input signal at each interval and using that reference input signal in the adaptive algorithm. The control unit maybe adapted to utilize a hysteresis technique to retain the preferred reference input signal for a period of time before the next preferred reference input signal is adopted.

Figure 2:
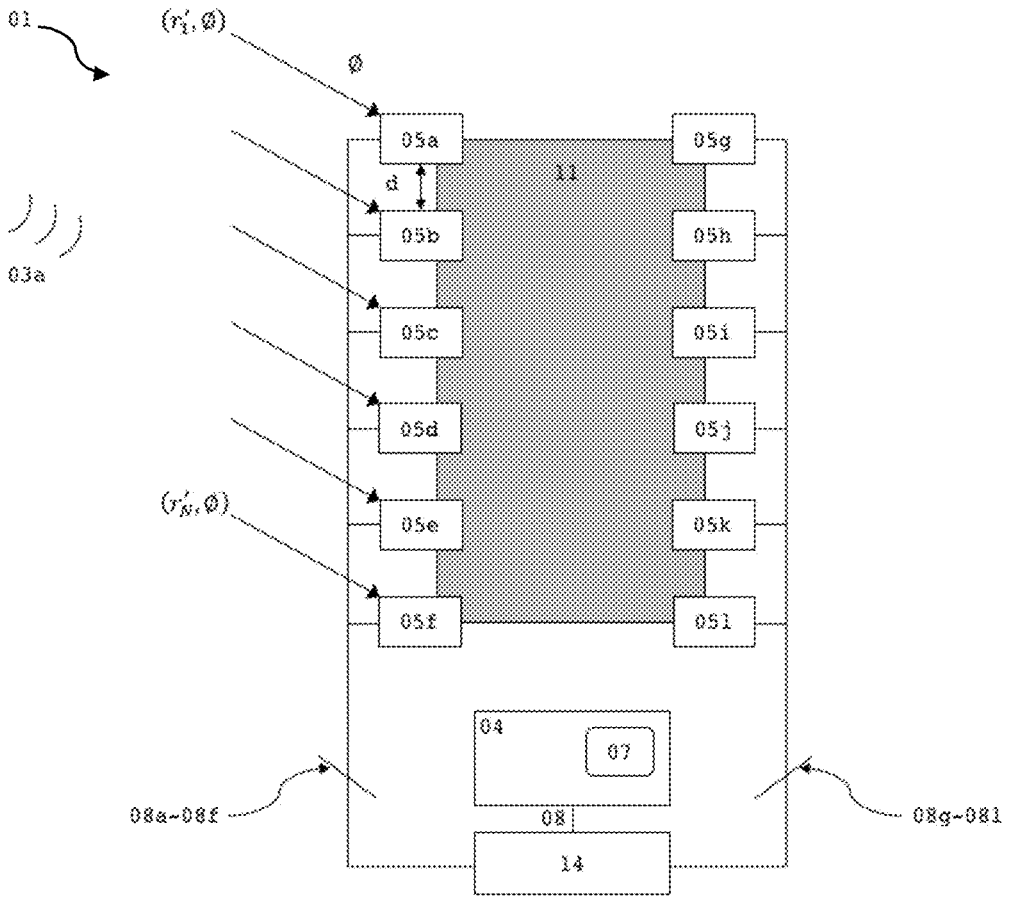
FIG. 2 shows an active noise control system with two linear arrays of reference input sensors responsive to more than one noise source.

In another embodiment, referring to FIG. 2, reference input sensors (05*a*-05*l*) are arranged in a set of linear arrays around a support surface (11). As shown, the arrays of reference input sensors are two parallel linear arrays (05*a*-05*f* and 05*g*-05*l*), although other spatial arrangements of reference input sensors, such as planar arrays, may be used. Linear arrays (05*a*-05*f* and 05*g*-05*l*) may be generally straight as shown, or may include some curvature. Each set of linear arrays (05*a*-05*f* and 05*g*-05*l*) is in data communication with the selector mechanism (14). The number and spacing of the reference input sensors are configured to allow localization of a sound to within at least a quadrant of the support surface (11). In FIG. 2, two linear arrays each having six reference input sensors are depicted, although the invention contemplates more or fewer reference input sensors per linear array and/or more or fewer linear arrays. In a preferred embodiment, two linear arrays are oriented along the two longer sides of the support surface (11) with at least three reference input sensors in each array. In another embodiment, two linear arrays are oriented along the two longer sides of the support surface (11) and two linear arrays are oriented along the two shorter sides of the support surface (11).

The sound wave (03*a*) of frequency f impinging on each of reference input sensors (05*a*-05*f*) at angle Ø and distance r and amplitude A results in pressure at the $i^{th}$ sensor with a pressure of $$p_i = \frac{A}{r_i'} e^{j(\omega t - k r_i')}$$

where $$k = \frac{2\pi f}{c},$$

where c is the speed of sound. The spacing of each reference input sensor is distance d from each other reference input sensor in the same linear array. For N reference input sensors, the total pressure received is $$p(r, \phi, t) = \sum_{i=1}^{N} \frac{A}{r_i'} e^{j(\omega t - k r_i^i)}$$

and the total pressure amplitude received is $$|p(r, \phi)| = \frac{NA}{r} H(\phi)$$

where H(Ø) is the directivity factor and is given by $$H(\phi) = \left| \frac{1}{N} \frac{\sin\left(\frac{N}{2} kd \sin\phi\right)}{\sin\left(\frac{1}{N} kd \sin\phi\right)} \right|$$

In some instances, the support surface (11) may be approximately one meter long, such as when the patient to be accommodated on the support surface (11) is an infant. With a number N reference input sensors (shown in FIG. 2 as reference sensors 05*a*-05*l*, such that N=6 for two linear arrays) being equally spaced along a one meter length, the distance between each reference input sensor is $$d = \frac{1m}{(N-1)}$$

Figure 3A:
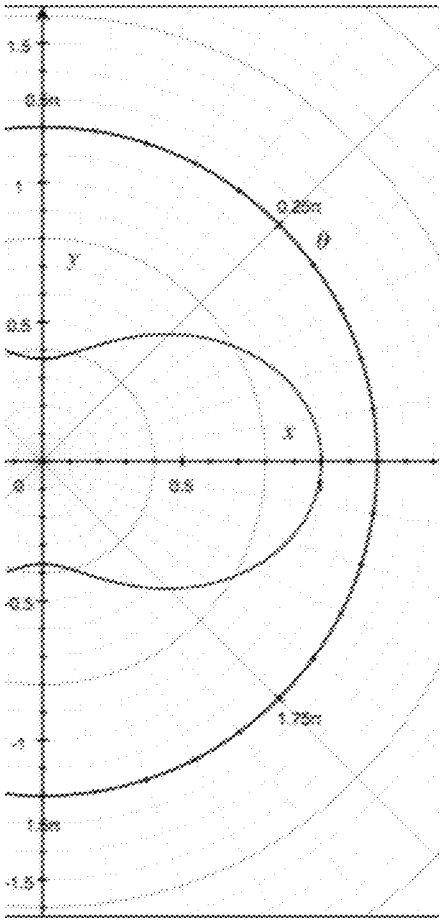
FIG. 3*a* shows a plot of the directivity factor for a 200 Hz sound wave.
Figure 3B:
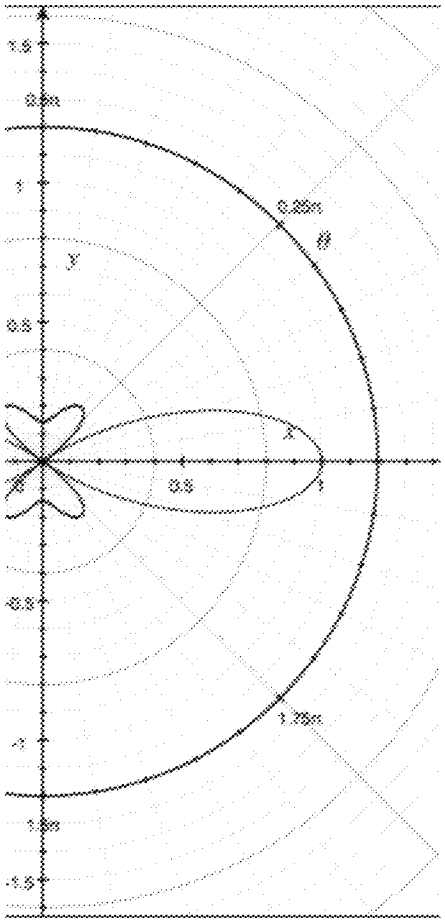
FIG. 3*b* shows a plot of the directivity factor for a 500 Hz sound wave.
Figure 3C:
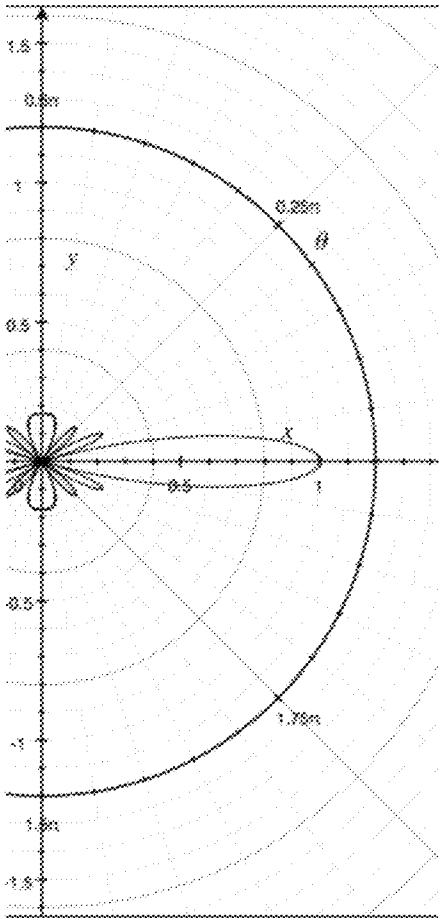
FIG. 3*c* shows a plot of the directivity factor for a 1000 Hz sound wave.

With, for instance, six reference input sensors distributed evenly along a one meter length of each side of the support surface (11), the plot of the directivity factor is shown in FIGS. 3*a*-3*c* for a 200 Hz, 500 Hz, and 1,000 Hz sound wave (03*a*) respectively. The directional capability of such an array of reference input sensors provides sufficient resolution to isolate the source of the noise source (02*a*) to at least a quadrant around the support surface (11).

Figure 4:
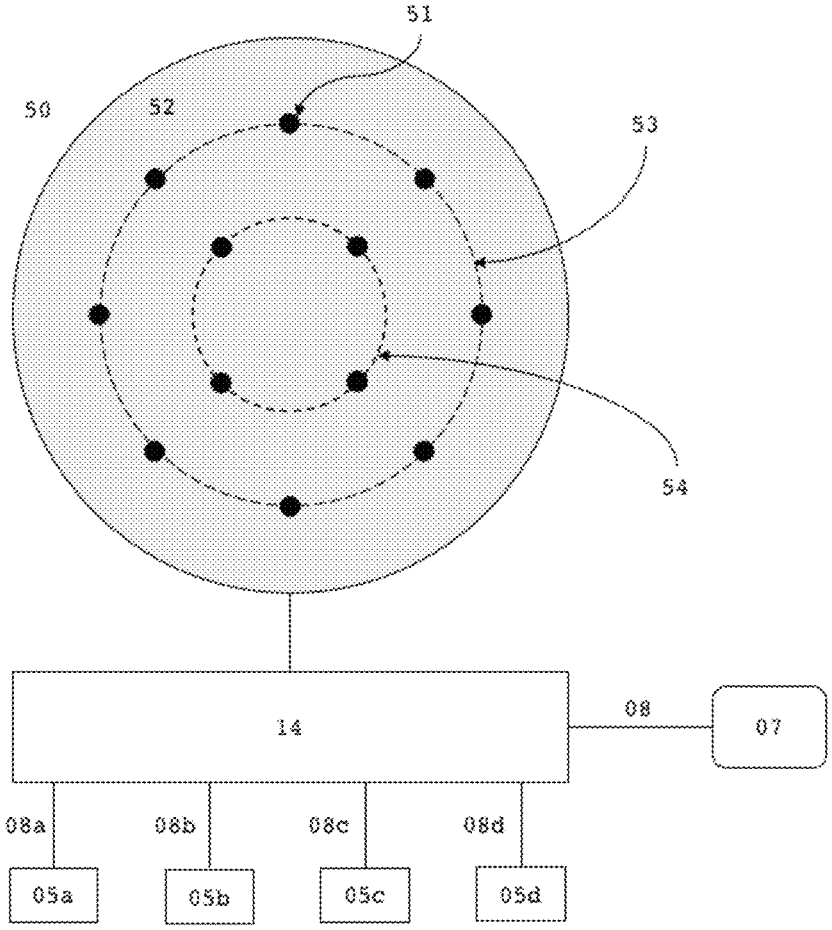
FIG. 4 shows an example of a selector mechanism for an active noise control system.

Referring now to FIG. 4, in some embodiments the selector mechanism (14) may receive inputs from a localizing microphone array (50). Localizing microphone array (50) is coupled with a filter-sum beamforming technique configured for use as a sound-source localizer. The localizing microphone array (50) acting as a sound-source localizer is in communication with selector mechanism (14). Selector mechanism (14) selects the preferred reference input signal (08) from an array of reference input transducers (05*a*, 05*b*, 05*c*, 05*d*) based on sound localization information from the localizing microphone array (50). The selected reference input signal (08) is directed to the active noise control algorithm (07). The localizing microphone array (50) is dimensioned and configured with sufficient localizing microphones (52) to enable localization of noise sound waves to within a quadrant around a support surface (11) in a horizontal plane. In some embodiments, the localizing microphones (52) are configured on a substrate (53) along a first path (54). In other embodiments, the localizing microphones (52) may be configured on a substrate (53) along a first path (54) and a secondary path (55).

In a sweep of the localizing microphones (52) of the localizing microphone array (50), the filter-sum beamforming algorithm will delay the output signal of each microphone (52) by a time (Δ) where Δ is dictated by the angle (θ) being scanned. Each of these output signals are then summed resulting in a polar steered response power. The time delay, $\Delta_m$, for a microphone, m, in the array is given as $$\Delta_m = \frac{\overrightarrow{r_m}\vec{k}}{c}$$

where $r_m$ is the position vector of microphone m on the microphone array, k is the unit vector normal to the noise source wave front with direction θ, and c is the speed of sound. The total output of the array is $$O(\theta, \omega) = \sum_{m=1}^{M} S_m(\omega) e^{-j\omega\Delta m(\theta)}$$

where $S_m(\omega)$ is the output signal of microphone m and M is the total number of microphones.

In a sound field Ø composed of many sound sources at distinct locations, the output is $$O(\theta,\phi)=O(\theta,S_1)+O(\theta,S_2)+\ldots+O(\theta,S_n)+\text{Noise}.$$

The power, P(θ, ϕ), of the array is found with the square of the absolute value of O(θ,ϕ). This is normalized to the maximum power output as the polar steering response power (PSRP).

$$PSRP(\theta, \phi) = \frac{P(\theta, \phi)}{\max_{\theta\in[0,2\pi]} P(\theta, \phi)}.$$

Figure 6:
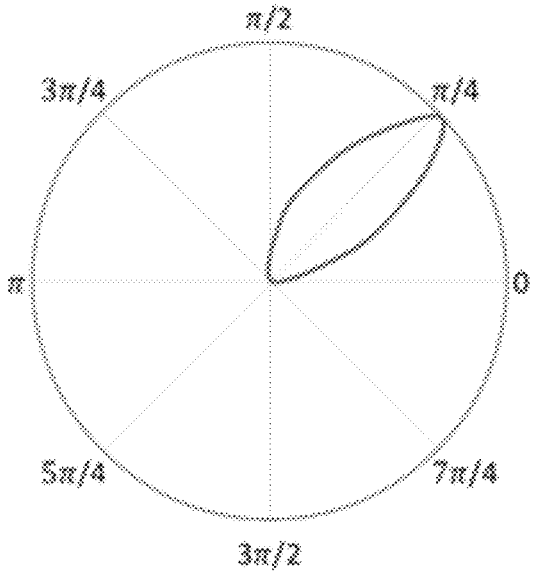
FIG. 6 shows a plot of a polar steering response power (PSRP) for a noise source at about $\pi/4$ radians.

By comparing P for different values of θ against the maximum value of P in a sweep defines the location of the sound source. A graph of the PSRP for a sound source at an angle θ in a sound field Ø, is shown in FIG. 6. The quality of the directivity index depends on the frequency of the source signal with higher frequencies being easier to pinpoint. However, the resolution requirements are broader than many direction of arrival (DOA) applications since the system only needs to select from four reference microphones arranged in each quadrant around a support surface. Limiting the number of angles to be scanned will increase the speed of a sweep. Further, in some embodiments, the scan does not include 360° but only 270° when the support surface (11) is positioned against a wall on one side. The directivity, $D_p(\theta, \omega)$, is found by dividing the area bound by the PRSP by the unit circle. This is given by $$D_p(\theta, \omega) = \frac{\pi P(\theta_0, \omega)^2}{\frac{1}{2}\int_0^{2\pi} P(\theta, \omega)^2 d\theta}$$

As long as this ratio remains above about ¼ when ω is varied, the localizing microphone array (50) will have the ability to localize the origin of a sound to at least a quadrant around the support surface. As co increases, the lobe of the polar plot, $D_p(\theta, \omega)$, narrows providing a more accurate directional indication of the sound origin. However, at low audible frequencies, the directionality is sufficient to indicate which of the four quadrants provides the selection of the proper reference microphone.

Figure 5:
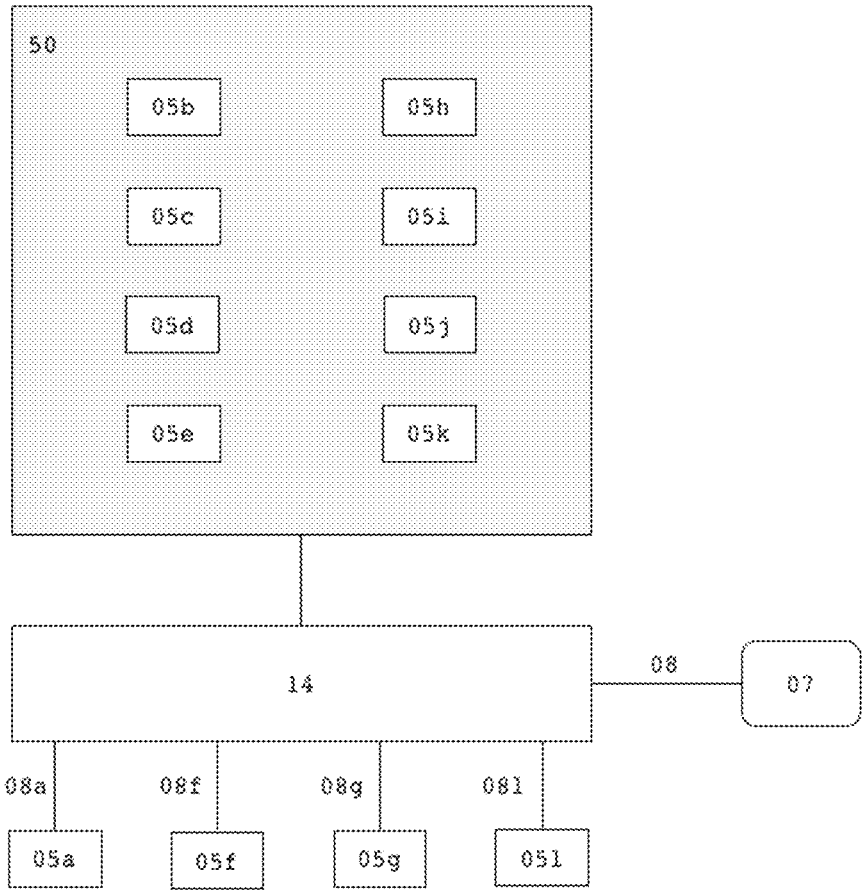
FIG. 5 shows another example of a selector mechanism for an active noise control system.

In an alternate embodiment, referring to FIG. 2, reference input sensors 05*b*-05*e* and reference input sensors 05*h*-05*k* represent a first and a second linear array used in the calculation of the directivity factor as previously described. Referring now to FIG. 5 for a detailed view of the selector mechanism 14, the selector mechanism 14 further receives input from a localizing microphone array (50) comprised of a first linear array (05*b*-05*e*) and a second linear array (05*h*-05*k*). The selector mechanism (14) utilizes the localizing microphone array utilizes the reference input signals (08*b*-08*e*, 08*h*-08*k*) to calculate a directivity factor and to select the preferred reference input signal from an array of reference input transducers (05*a*, 05*f*, 05*g*, 05*l*). The selected reference input signal (08) is directed by the selector mechanism (14) to the control unit (04) executing the active noise control algorithm (07)

In an embodiment, the active noise control system (01) is found in an environment with a plurality of noise sources (02*a*, 02*b*). The active noise control system (01) comprises a plurality of reference input sensors (05*a*, 05*b*, 05*c*, 05*d*). In FIG. 1, this is shown as four reference input sensors although in practice, this could be many more reference input sensors. Preferably, the number of reference input sensors would be four although more or fewer are also contemplated. The control unit (04) is adapted to analyze the respective reference signals (08) of these reference input sensors as an array of sensors and is further adapted to analyze the frequency and phase response from each of these reference signals (08) such that the control unit is able to discern the direction that any given noise source is relative to the array of reference input sensors. In an approximation, the noise sources (02*a*, 02*b*) are considered to be coplanar although it is also contemplated that an appropriate number and arrangement of reference input sensors would discern the three-dimensional location of any of the noise sources. In use, the reference input sensors may be deployed on the corners of the support surface (11) although other arrangements are envisioned as part of this invention. The control unit is further adapted to use the direction of any given noise source to calculate the reference input sensor that is closest to the given noise source. The active noise control algorithm (07) is configured to selectively use the input from the reference input sensor that is most suitable for use. Factors that are weighted by the active noise control algorithm (07) include sound pressure level, periodicity, duration, duty cycle, phase, and other factors. The active noise control system (01) is configured to select the reference signal (08) most likely to be effectively attenuated from the plurality of reference input signals (08*a*, 08*b*, 08*c*, 08*d*). In an embodiment, the active noise control algorithm (07) cycles through each reference microphone of the microphone array, identifying the reference microphone of the microphone array corresponding with the loudest sound.

Figure 7:
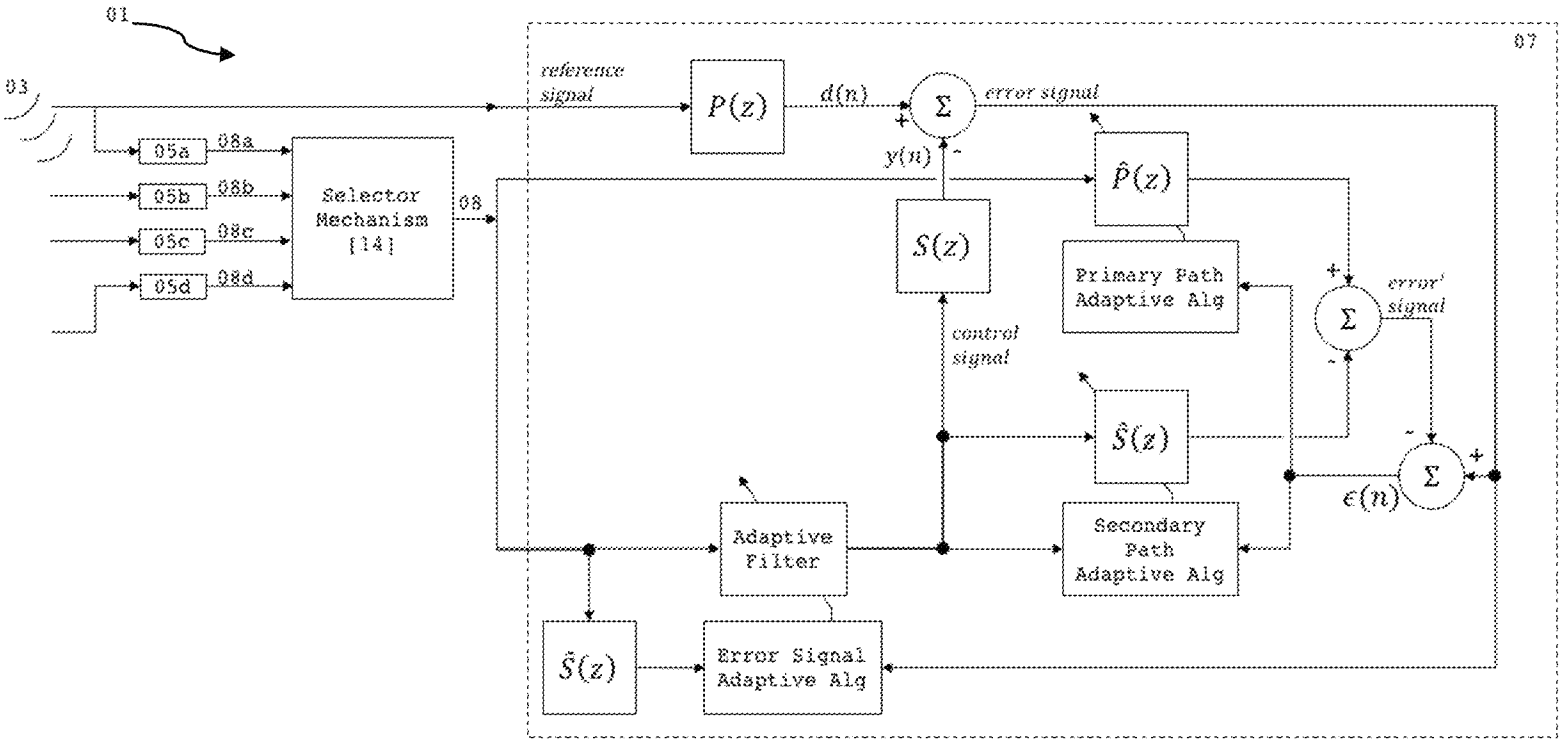
FIG. 7 shows a selector mechanism and its connection to an active noise control algorithm.

Referring now to FIG. 7, an embodiment of the active noise control system (01) is shown, highlighting the interaction between the reference input signals (08), the selector mechanism (14), and the active noise control algorithm (07). Other embodiments of an active noise control algorithm based on a selected reference signal (08) input are contemplated with this invention. In some embodiments, a sound wave (03) impinges on the reference input sensors (05*a*-05*d*), generating corresponding reference input signals (08*a*-08*d*). In this embodiment, four reference input sensors are represented for illustration purposes. In other embodiments, the plurality of reference input sensors may include other numbers of sensors, for example two sensors, three sensors, six sensors, or eight or more sensors. The sound wave (03) also enters the environment proximate the active noise control system (01). The selector mechanism (14) selects the most appropriate of the reference input signals (08*a*-08*d*) and presents a selected reference input signal (08) to the control unit (04) executing the active noise control algorithm (07). The sound wave (03) passes through a primary pathway P(z) between the reference input sensors (05*a*-05*d*) and the spatial zone as d(n). The selected reference input signal (08) is mathematically transformed by an adaptive filter of the active noise control algorithm (07), wherein the adaptive filter is modified by an error signal adaptive algorithm. The output of the adaptive filter is sent through the control signal output transducer and through a secondary pathway S(z) towards the spatial zone as y(n). Signals d(n) and y(n) converge on the spatial zone and deconstructively interfere with each other. The resulting sound is the error signal. The error signal is used by the error signal adaptive algorithm to alter the adaptive filter to converge on a solution to improve the match of the control signal as transformed by the secondary pathway S(z) and minimize the magnitude of the error signal. The model of the primary pathway $\hat{P}(z)$ and the model of the secondary pathway $\hat{S}(z)$ are refined by the primary pathway adaptive algorithm and the secondary pathway adaptive algorithm. These two algorithms are presented with an error of the error signal, $\epsilon(n)$, found by combining the error signal with an error' signal based on the control signal altered by the model of the secondary pathway $\hat{S}(z)$ and the reference input signal altered by the model of the primary pathway $\hat{P}(z)$. The difference of the error signal and the error' signal, $\epsilon(n)$, provides an indication of the quality of the models of the primary and secondary pathways, $\hat{P}(z)$ and $\hat{S}(z)$. The model of the secondary pathway $\hat{S}(z)$ is used in conjunction with the error signal with the error signal adaptive algorithm to improve the adaptive filter that generates the control signal, which provides a canceling sound wave.

The invention may be embodied in other specific forms without departing from the spirit or essential characteristics thereof. The foregoing embodiments are therefore to be considered in all respects illustrative rather than limiting on the invention described herein. Scope of the invention is thus indicated by the appended claims rather than by the foregoing description and all changes that come within the meaning and range of equivalency of the claims are therefore intended to be embraced therein.

All references cited in this specification are hereby incorporated by reference. The discussion of the references herein is intended merely to summarize the assertions made by the authors and no admission is made that any reference constitutes prior art. Applicants reserve the right to challenge the accuracy and pertinence of the cited references.

We claim:

1. A noise cancellation apparatus comprising:

a plurality of reference input sensors arranged around a perimeter of a spatial zone, wherein the plurality of reference input sensors generate a plurality of reference input signals in response to one or more noise sound waves generated by one or more noise sources;

a localizing microphone array comprising a plurality of localizing microphones;

a selection mechanism coupled to the localizing microphone array and to the plurality of reference input sensors, wherein the selection mechanism is configured to select a reference control signal based on sound localization information from the localizing microphone array, and wherein the selection mechanism is further configured to select the reference control signal from the plurality of reference input signals based on a first criteria, wherein the first criteria is selected from the group consisting of sound pressure level, amplitude, frequency, periodicity, and direction;

a control element in communication with the selection mechanism;

an error input sensor proximate to the spatial zone within the perimeter, wherein the error input sensor is in communication with the control element; and an output control transducer in communication with the control element, wherein the control element is configured to execute an adaptive noise control algorithm in response to the reference control signal received from the selection mechanism and the error signal received from the error input sensor, and wherein the adaptive noise control algorithm generates an output control signal for the output control transducer to generate a control sound wave configured to destructively interfere with the one or more noise sound waves when the one or more noise sound waves enter the spatial zone.

2. The noise cancellation apparatus of claim 1, wherein the reference input sensors are microphones.

3. The noise cancellation apparatus of claim 2, wherein the reference input sensors comprise between four to eight microphones.

4. The noise cancellation apparatus of claim 1, wherein the control element comprises a digital signal processor.

5. The noise cancellation apparatus of claim 1, wherein the plurality of reference input sensors is adapted for positioning around a perimeter of a support surface.

6. The noise cancellation apparatus of claim 1, wherein the plurality of reference input sensors are arranged in an array.

7. The noise cancellation apparatus of claim 1, wherein the selection mechanism is configured to select a reference control signal from the plurality of reference input signals based on the first criteria and a second criteria, wherein the second criteria is selected from the group consisting of sound pressure level, amplitude, frequency, periodicity, and direction.

8. The noise cancellation apparatus of claim 1, wherein the localizing microphone array is coupled to a sound source localizer.

9. The noise cancellation apparatus of claim 8, wherein the sound source localizer localizes noise sound waves within a quadrant in a horizontal plane.

10. A noise cancellation method, the method comprising:

providing a plurality of reference input sensors arranged around a perimeter of a spatial zone;

providing a localizing microphone array comprising a plurality of localizing microphones;

receiving at a selection mechanism a plurality of reference sensor inputs representative of one or more noise sound waves from the plurality of reference signal sensors and receiving at the selection mechanism sound localization information from the localizing microphone array;

selecting at the selection mechanism a reference control signal from the plurality of reference input signals based on the sound localization information from the localizing microphone array, wherein step of selecting the reference control signal at the selection mechanism comprises selecting on the basis of a first criteria, wherein the first criteria is selected from the group consisting of sound pressure level, amplitude, frequency, periodicity, and direction;

providing the reference control signal from the selection mechanism to a control unit;

providing an error input signal to the control unit from an error input sensor proximate to the spatial zone;

executing an adaptive noise cancellation algorithm at the control unit, based on the reference control signal and the error input signal;

providing an output control signal from the control unit to an output control transducer to generate a control sound wave configured to destructively interfere with the one or more noise sound waves when the one or more noise sound waves enter the spatial zone.

11. The method of claim 10, wherein the step of providing plurality of reference input sensors comprises providing a first array of reference input sensors.

12. The method of claim 11, further comprising the step of providing a second array of reference input sensors.

13. The method of claim 12, where the first array and second array are linear arrays.

14. The method of claim 10, wherein the reference control signal is mathematically transformed by an adaptive filter of the active noise control algorithm.

15. The method of claim 14, wherein the adaptive filter is modified by an error signal adaptive algorithm.

16. The method of claim 10, wherein the control unit is a digital signal processor configured to execute the adaptive noise control algorithm.

17. The method of claim 10, wherein step of selecting a reference control signal at the selection mechanism further comprises selecting on the basis of a second criteria, wherein the second criteria is selected from the group consisting of sound pressure level, amplitude, frequency, periodicity, and direction.

18. The method of claim 10, wherein the plurality of reference input sensors is adapted for positioning around a support surface of a neonatal incubator.

19. The noise cancellation method of claim 10, wherein the localizing microphone array is coupled to a sound source localizer.

20. The noise cancellation method of claim 19, wherein the sound source localizer localizes noise sound waves within a quadrant in a horizontal plane.

* * * * *